US010244874B2

(12) United States Patent
Markarian et al.

(10) Patent No.: US 10,244,874 B2
(45) Date of Patent: Apr. 2, 2019

(54) FOLDOVER FOR LOSS PREVENTION AND IMPROVED MERCHANDISING

(71) Applicant: Contempo Card Company, Providence, RI (US)

(72) Inventors: Michael Markarian, Providence, RI (US); Ed Benjamin, Providence, RI (US)

(73) Assignee: Contempo Card Company, Providence, RI (US)

( * ) Notice: Subject to any disclaimer, the term of this patent is extended or adjusted under 35 U.S.C. 154(b) by 0 days.

(21) Appl. No.: 16/071,477

(22) PCT Filed: Jan. 20, 2017

(86) PCT No.: PCT/US2017/014462
§ 371 (c)(1),
(2) Date: Jul. 19, 2018

(87) PCT Pub. No.: WO2017/127765
PCT Pub. Date: Jul. 27, 2017

(65) Prior Publication Data

US 2019/0021522 A1 Jan. 24, 2019

Related U.S. Application Data

(60) Provisional application No. 62/281,066, filed on Jan. 20, 2016.

(51) Int. Cl.

| | |
|---|---|
| ***A47F 7/02*** | (2006.01) |
| ***A47F 7/024*** | (2006.01) |
| ***G08B 13/24*** | (2006.01) |
| ***A44C 19/00*** | (2006.01) |
| ***G08B 13/196*** | (2006.01) |
| ***A47G 25/14*** | (2006.01) |

(52) U.S. Cl.
CPC ..... *A47F 7/024* (2013.01); *A44C 19/00* (2013.01); *A47G 25/1407* (2013.01); *G08B 13/19619* (2013.01); *G08B 13/2402* (2013.01); *G08B 13/19626* (2013.01)

(58) Field of Classification Search
CPC ..... A47F 7/024; A44C 19/00; G08B 13/2402; G08B 13/19619; G08B 13/19626; G09F 9/313; A47B 61/00; A47G 25/1407
USPC ..... 340/568.8
See application file for complete search history.

(56) References Cited

U.S. PATENT DOCUMENTS

2008/0278321 A1* 11/2008 McQueen ..... G08B 13/19619 340/568.1
2015/0272364 A1* 10/2015 Larsen ..... G09F 9/313 223/96

* cited by examiner

*Primary Examiner* — Ali Neyzari
(74) *Attorney, Agent, or Firm* — PCK IP Lawyers (USA) P.C.; Alan F. Feeney

(57) ABSTRACT

An anti-theft display hanger comprising a foldover which when engaged allows for the display of fashion jewelry, traditionally necklaces, pendants and necklaces, to be more secure, harder to steal, and permanently held in a desired position until disengaged while still presently enclosed merchandise in the most aesthetically, desirable manner for the consumer.

19 Claims, 2 Drawing Sheets

FOLDOVER FOR LOSS PREVENTION AND IMPROVED MERCHANDISING

CROSS REFERENCE TO RELATED APPLICATIONS

This application is a continuation under 35 U.S.C. § 371 of International Application No. PCT/US2017/014462, filed on Jan. 20, 2017, which claims priority to U.S. Provisional Patent Application No. 62/281,066, filed Jan. 20, 2016, and entitled "FOLDOVER FOR LOSS PREVENTION AND IMPROVED MERCHANDISING." The entireties of the aforementioned applications are hereby incorporated by reference herein.

TECHNICAL FIELD

The invention relates generally to an anti-theft hanger that allows for a more aesthetic way to display jewelry, in particular necklaces and bracelets, in a retail setting, more particularly, an improved anti-theft hanger used to display necklaces and bracelets and other jewelry which supports said jewelry in a desired way while concealing an electronic article surveillance sensor.

BACKGROUND OF THE INVENTION

Jewelry can be classified as either "fine" or "fashion" depending on the jewelry materials. Fine jewelry is made of precious metal and/or set with precious or semi-precious gemstones and/or cultured or natural pearls whereas fashion jewelry is not made of precious metals (except precious metal plating over non-precious/base metal) and does not contain any of the precious or semi-precious gemstones, pearls, or other materials. According to the U.S. Department of Commerce, between 2010 and 2015, total jewelry and watch sales in the United States have grown at a CAGR (compounded annual growth rate) of 4.4%, reaching $74.7 billion in 2014 (Key D, Market Realist, 9, Dec. 2015).

Most fashion jewelry is sold in big box stores such Walmart, Kohls, Macys, J.C. Penny's and Target. Since fashion jewelry is made from lesser quality metals and other materials so as to be affordable to certain populations in the market, they are sold at a low profit margin, unlike fine jewelry. The sale of fashion jewelry becomes profitable for the retailer when the retailer sells a large number of the items to customers. Purchases of fashion jewelry, as opposed to purchases of fine jewelry, tend to be made on the spur of the moment with the purchaser never intending to have made the purchase at that time, i.e., an impulse purchase. In order to increase sales of fashion jewelry and encourage impulse buying, a retailer must present the items in an aesthetically pleasing way so as to entice the purchaser into making the impulse purchase.

Traditionally, fine jewelry is displayed in glass cases with sales attendants removing the desired piece from the case and presenting it to the potential buyer to examine and admire. The customer can never be in possession of the item without the constant supervision of the sales staff. Because of the low profit margin from a sale of fashion jewelry, retailers cannot devote entire glass displays and/or sales staff to the display and sale of fashion jewelry. The big box retailers generally utilize foldover hangers to showcase fashion jewelry. The hangers are comprised of two mirror-image sections having a connecting portion or gusset between the sections so that when the two mirror-image sections are folded towards each other, an enclosed recess is created. When a retailer desires to display an item of fashion jewelry such as a necklace, the necklace is placed over the tag and positioned over the gusset. When the sides of the hanger are folded inward and the two mirror images are overlayed, the necklace is secured within the tag. The mirror image sides are designed to form a hook-like means in which to hang the necklace on a display rack. Alternatively, both sections may have holes so that when the holes are lined up, the hanger with the necklace can be placed on a hook or peg. Generally, the two sides are held together by an adhesive, such as glue. A retailer can display a great number of the same item, thus increasing sales.

Retailers traditionally display a large amount of fashion jewelry out on its display floor, usually amongst clothing and other types of apparel. Fashion jewelry displayed in this manner is traditionally unsupervised by a sale staff member and the customer is free to remove the item from the display to examine and admire. Because there is little supervision, the likelihood of shop-lifting of fashion jewelry is high.

There are approximately 27,000,000 people who currently shoplift in the U.S. Of that, 10,000,000 people who have been caught shoplifting within the past five years. Total amount stolen from retailers each year is approximately $13,000,000,000. The median price of a theft is $37.50, the average price of a lot of fashion jewelry. Most fold-overs on the market today, however make fashion jewelry, such as necklaces easy to steal. The shoplifter can easily open the fold-over with a key, scissors or pocket knife, undo the clasp of the item removing it from the hanger, and thereafter pocket the jewelry.

Traditional theft-prevention fold-overs on the market lack the ability to display the fashion jewelry in a permanent, aesthetically pleasing manner that encourages an impulse purchase of the item. Most foldovers on the market today can cause the jewelry to slide and move within the foldover causing the jewelry to become crooked looking undesirable to the customer considering a purchase, thus minimize the number of impulse purchases required to make the sale of fashion jewelry profitable to the retailer.

Accordingly, there is a continued need in the art of anti-theft tags for tags that are difficult to remove while still displaying the item in an aesthetically pleasing way so as to encourage "impulse" purchases of fashion jewelry. Retailers of jewelry need an anti-theft jewelry display hanger that reduces theft while improving merchandising of their products.

BRIEF SUMMARY OF THE INVENTION

An object of the present invention is to provide an anti-theft display hanger which is easy to manufacture and assemble, cost effective, and which can be used without being readily discovered and/or removed by consumers.

In accordance with one aspect, there is provided an anti-theft display hanger including a body portion having at least a first member including and a second member designed to overlay the first member forming a gusset having a dieline at the gusset which creates two flaps wherein when said flaps are folded inward towards each other, the preformed holes in said flaps align, allowing a shortened cable to secure the jewelry to the hanger in the desired position.

In another embodiment of the claimed invention, an EAS sensor, preferably supported within a recess of the either member such that it is substantially co-planar with or below the inside surface of the members, is a part of the invention. The body portion is preferably folded such that the second member at least partially overlays the first member. The first and second members are connected by a gusset for supporting an article, for example a necklace, when the second member overlays the first. Flaps embedded in the gusset and having preformed apertures therein, provide a means in which to secure an article of jewelry to the hanger using a fastening means such as cable tie. An engagement member, for example a hook or aligned set of holes, may also be provided for supporting the hanger on a rod, post or the like. The body portion may also include indicia, such as price, manufacturer, or other information for display to the consumer.

BRIEF DESCRIPTION OF THE DRAWINGS

It should be understood that the drawings are provided for the purpose of illustration only and are not intended to define the limits of the invention. The foregoing and other objects and advantages of the embodiments described herein will become apparent with reference to the following detailed description when taken in conjunction with the accompanying drawings in which.

DETAILED DESCRIPTION OF THE INVENTION

Figure 1:
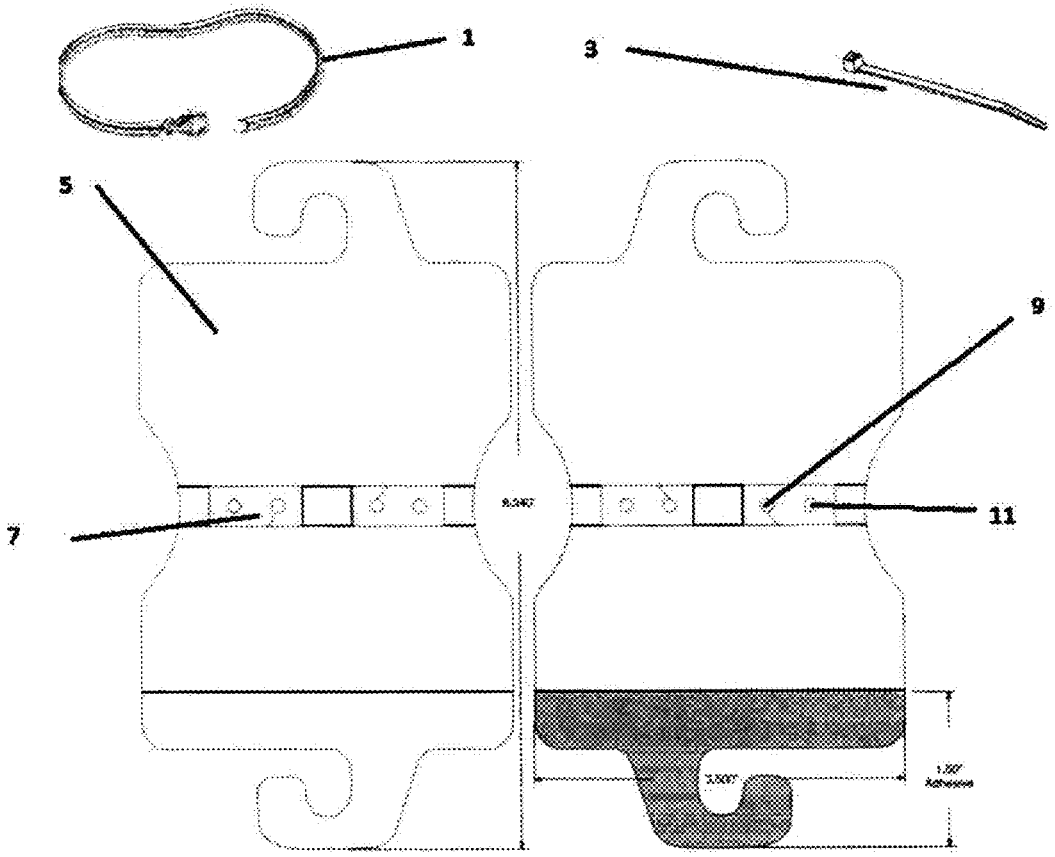
FIG. 1 is a perspective view of the anti-theft hanger in an open, unassembled position.
Figure 2:
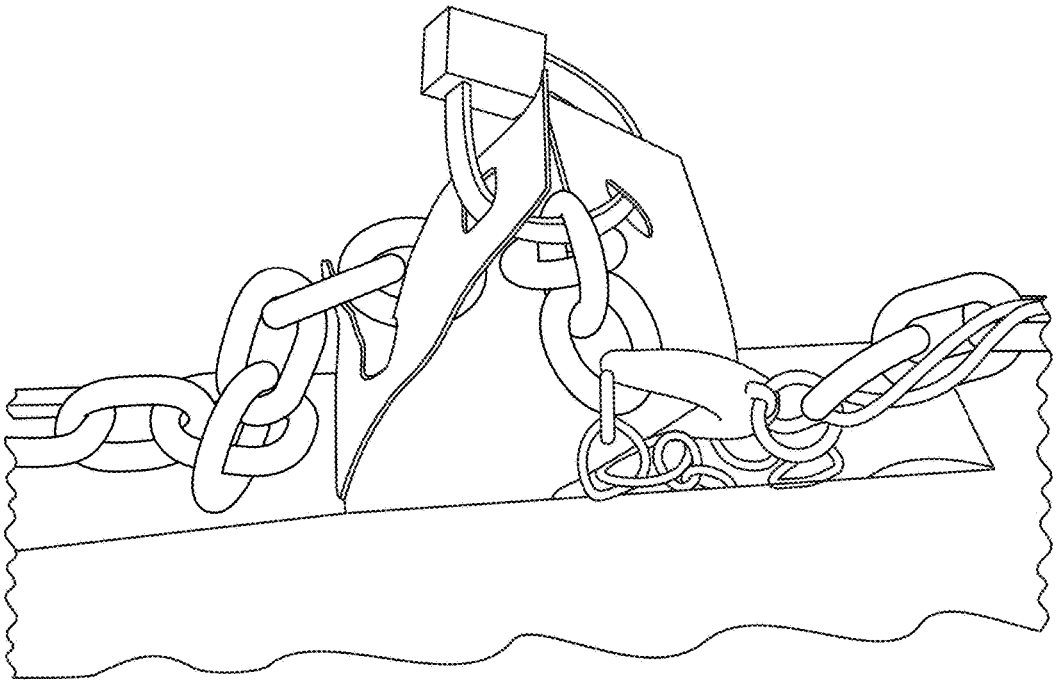
FIG. 2 is illustration of the inner flaps of the gusset after a bracelet has been installed into the hanger and secured therein by the shortened cable tie before the members of the device have been folded over so as to overlay one member on the other member.

A first embodiment of an anti-theft display hanger, also referred to herein as the "foldover," (FIG. 2) for supporting an article and deterring theft of the article is illustrated in FIGS. 1 and 2. As used herein, the term "article" refers to any item or product sold to a consumer, and is not limited to the particular articles disclosed herein. As used herein, the term "gusset" is the flat bottom of the hanger created when the two side members are folded inward so as to overlay on each other. The two side members are attached to the gusset so as to create space within the hander to contain an article. As used herein, the term "dieline" refers to a package template that ensures proper layout for a printed product. It is a diagram that shows all the cut lines and folds of a package in flattened form. As also used herein, the term "electronic article surveillance sensor" is used in the conventional sense to mean any of a number of sensors, as would be known to those of skill in the art. For example, the sensor can be a common EAS sensor or one that may comprise a ferro magnetic member. EAS sensors are widely available and may be purchased from such companies as Sensormatic Electronics Corporation of Boca Raton, Fla.

This invention is manufactured like a traditional foldover, except there is a special dieline at the gusset 7 of the foldover. This dieline creates two flaps allowing the lobster claw and jump ring of article, for example a necklace 1, to be enclosed or secured between the two flaps. There are holes 9 in each flap 11, which allows for a shortened cable tie 3 to run through the hole in one flap, then the article, such as a necklace 1 (via different means, for instance, the lobster claw or jump ring), then through the hole on the opposing flap. When the cable tie is then zipped and the sides of the foldover are adhered together, the necklace stays in place perfectly.

Once the foldover is popped open, the shoplifter would need to cut the table tie, which a sharp object such as scissors or a knife, to gain access to the clasp of the article in order to steal the article. In some embodiments, the anti-theft display hanger would have a body portion having at least a first body member having a recess for supporting an electronic article surveillance sensor, so that the potential shoplifter would not be able to take the whole foldover out of the store without the sensor going off. The electronic article surveillance sensor is preferably supported within the recess of the first member such that it is substantially co-planar with or below the inside surface of the first member. Even if there was no sensor, a potential shoplifter would likely be afraid that there may be a sensor and may be deterred from stealing the article. Furthermore, by keeping the clasp in the location due to the flaps and cable tie, the necklace will sit perfectly, and will hang evenly, and will be merchandised in a professional manner.

Anti-theft display hanger FIG. 2 includes a body portion 5 having at least a first member including a dieline which creates a gusset 7 sized to support an article such as fashion jewelry and in particular a necklace, pendant or bracelet as well as a conventional electronic article surveillance sensor (not shown), and a second member designed to at least partially overlay the first member. The first member preferably includes an outer surface, an inner surface, a top portion and a bottom portion. The first member also preferably has a thickness defined between the outer surface and inner surface which is of sufficient thickness to form recess therein in order to support the electronic article surveillance sensor, if desired. The depth of the recess is preferably defined by the thickness of the first member and the dimensions of the gusset. The top portion of the first member may preferably include an engagement member, which is in the shape of a hook for engagement with a support structure, for example a display rack, rod, or the like, in the present embodiment, or it may contain a hole or aperture that when aligned with a similar hold in the second member, allows for the hanger to be secured to a peg or placed on a kook. The second member may preferably be a mirror image of the first member and may likewise include an outer surface, an inner surface, a top portion and a bottom portion. The top portion may also include hook, hole or aperture that is a mirror image of the hook, hole or aperture found in the first member. If the second member is a mirror image of the first member, the inner surface of the second member will substantially overlay the inner surface of the first member when assembled.

An adhesive may be placed on the inner surface of the second member, or the first member, or both, in order to secure the first and second members in the assembled position. In the present embodiment, an adhesive is placed over the inner surface of the second member and is covered with a protective sheet (not shown). The protective sheet is removed to expose the adhesive during assembly, as is known in the art. Possible adhesives to permanently attach one member to the other include, but are not limited to acrylics, bio-adhesives, contact adhesive, cyanoacrylics, epoxy, glue, hot melt adhesives, polyester resins, polyols, polyurethane, pressure sensitive adhesive and rubber cement.

The first member of the claimed hanger should have a thickness sufficient to create a recess to hold an electronic article surveillance sensor, however, the thickness may be split between both the first and second member. If the thickness is split between the first and second member, each member would include a cooperative recess that align with, and overlay each other, when assembled. In this manner, a single sensor would be placed within the recess of the first member, but would not be flush with the inner surface of the first member and would, instead, have a thickness greater than inner surface of the first member. Upon overlaying the second member, however, the recess formed therein would enclose the sensor completely so that the overall thickness of the body of the first and second members together would be about equal to or greater than that of the sensor. In this manner, the sensor would remain hidden within the body of the hanger because the inner surface of the first and second members are in contact and planar with respect to each other, i.e. there is no visible bulge to indicate the presence of a sensor which is enclosed within the recesses.

Prior to assembly, anti-theft display hanger is an open, or non-assembled position as shown in FIG. 1. As illustrated, the first and second members, along with the gusset 7 are in a planar position. In this position, the electronic article surveillance sensor is placed within the a recess formed in one or both members. The electronic article surveillance sensor is supported within the recess, for example by adhesive disposed on the bottom of the recess. In this manner, the sensor is flush with the inner surface, or below the inner surface. Thus, when assembled, there is no bulge formed, or other indication of the presence of a sensor within the hanger.

Prior to attaching the article, the two flaps created by the dielines are folded inward towards each other so that the holes in each align. If the article is a necklace 1, for example, the lobster claw and/or jump ring of necklace are inserted into the aligned holes of the flaps. To secure the article to the hanger, a shortened cable tie is also inserted into the two holes of the flaps and when said cable tie is engaged, the two flaps are secured together by the cable tie. In another embodiment, the cable tie, prior to being engaged, is threaded through the lobster claw and/or the jump ring, and the article is secured in place to the hanger when the cable tie cable tie is threaded through the aligned apertures of the flaps and then the cable tie is engaged, i.e. is "zipped". The second member is, thereafter, positioned over the first member and is secured thereto. In the present embodiment, the second member is the mirror image of the first member, and the inner surface of the second member includes an adhesive to secure the first and second members together. As the second member is moved into position over the first member, the gusset for supporting necklace 1 is formed. The gusset is formed between the two members which are spaced from each other in the assembled position. In this manner, a passageway is formed, which has a width sufficient for necklace. Indicia (not shown) such as the price, manufacturer, trademarks etc., may also be provided on the outer surface of the first and/or second members, as desired.

The anti-theft display hanger disclosed herein is easy to assemble, provides support to an article and means in which to keep said article is its most desirable position, prevents the easy removal of the article from the hanger while helping to prevent theft of the article by supporting a hidden electronic article surveillance sensor therein, and is cost effective.

The anti-theft security hanger is like any other theft-prevention foldovers in terms of design and structure. Anyone of ordinary skill in the art of manufacturing foldovers would be able to manufacture the claimed device. Manufacturing requires a steel rule die with a dieline to create the two flaps, as well as a cable tie to secure the article to the hanger. The two flaps, along with the cable tie, create both the loss prevention feature of the present invention, as well as improved merchandising feature by allowing for the fixed placement of the article within the hanger. In the preferred embodiment, 15 point shiny white plastic (Wepco Plastics, Inc., Middlefield, Conn.), with a 0.375" gusset and overall dimensions of 3.5 by 6.54 inches was used to create the device. Also in the preferred embodiment, a 4" white zip tie (Nelco Products, Pembroke, Mass.) to secure the article to the hanger was used, however, a zip tie of a different length or a different component entirely may be used to secure the article to the hanger. Excess plastic from the zip tie after it was engaged was cut and discarded. The foldover may be made out of plastic, board or any other material, plastic, however, is preferred as it is the most durable material. In another embodiment, the foldover hanger may be of any thickness. The foldover may have branding in the form of a laminated paper, print or hot stamp. In yet another embodiment, a self-locking version of a foldover, which does not use adhesive as a typical foldover does, may be used to secure the members once overlayed. The size of the foldover, as well as the size of the gusset, can vary. In addition to necklaces, pendants and bracelets, the present invention may be modified to accommodate an earring set as well as for chains of different sizes, though the hanger works best with thinner chains.

To remove the article from the anti-theft security hanger after purchase, the buyer simply cuts the cable tie, and the necklace, pendant, chain, bracelet and/or earing set is easily released from the foldover. Fasteners, besides a cable ties, may be used but cable ties are preferred. In yet another embodiment, slits are made into each flap, below the holes where the cable tie runs through, to further secure the necklace in place. These slits could also be holes and are optional, though helpful to the overall invention. In the preferred embodiment, the slits were staggered, however, the slits could be on only one flap, or not at all.

It will be understood that various modifications may be made to the embodiment disclosed herein. For example, it should be understood that the display hanger need not be unitary in construction. In addition, the gusset may be formed in a unitary first member, i.e., the first member may have a thickness formed as a unitary piece instead of as separate pieces adhered together. Also, although shown as generally rectangular, the hanger may be other shapes, as would be known to those of skill in the art. Additionally, the article supported on the hanger may be any article and is not limited to necklaces, or even jewelry, therefore, the above description should not be construed as limiting, but merely as exemplifications of a preferred embodiment. Those skilled in the art will envision other modifications within the scope, spirit and intent of the invention.

What is claimed is:

1. An anti-theft display hanger for supporting an article, comprising: a first member having an outer surface, an inner surface, a top portion, a bottom portion and a thickness defined between the outer surface and inner surface; a second member having an outer surface, an inner surface, a top portion, a bottom portion and a thickness defined between the outer surface and inner surface, the second member being constructed and arranged to overlay at least a portion of the first member in an assembled position; a gusset disposed between the bottom portion of the first member and the bottom portion of the second member and having one or more dielines wherein said dielines create two flaps when the hanger is assembled and further wherein said flaps contain apertures that line up when the hanger is assembled; a recess in one or both members in which to support an electronic article surveillance sensor, the recess being sized to support the sensor therein and having a depth dependent upon the thickness of the first member such that upon supporting the sensor within the recess, the sensor is planar with or below the inner surface of the first member; an engagement member constructed and arranged to support the hanger on a display; means in which to secure the first member to the second member when assembled; and means to secure said article to said hanger; wherein upon assembling the hanger, the second member overlays the first member so as to conceal the electronic article surveillance sensor, the flaps when folded in and towards each other so that the apertures contained therein allow for the securing means to be threaded through said apertures and thereafter capable of securing said article to said hanger, provided when said article is secured to the hanger said article is unable to move within said hanger.

2. The anti-theft display hanger of claim 1, wherein the second member is a mirror image of the first member.

3. The anti-theft display hanger of claim 1, wherein said means in which to secure the article to the hanger is a cable tie.

4. The anti-theft display hanger of claim 1, wherein said means to secure said first member to said second member is an adhesive.

5. The anti-theft display hanger of claim 4, wherein said second member includes an adhesive on the inner surface.

6. The anti-theft display hanger of claim 1, wherein said means to secure said first member to said second member is a non-adhesive, self-locking device.

7. The anti-theft display hanger of claim 1, wherein the engagement member is a hook.

8. The anti-theft display hanger of claim 1, wherein the engagement member is a series of apertures in both members that line up when the hanger is assembled creating a means upon which to display the article on a hook or a peg.

9. The anti-theft display hanger of claim 1, further comprising a recess wherein the depth of the recess is defined by the thickness of the first member and second members and further wherein the depth of the recess determines the size of the article secured therein.

10. The anti-theft display hanger of claim 1, wherein the first and second members are formed as a unitary piece.

11. The anti-theft display hanger of claim 1, wherein the article is threaded through the aligned apertures of the flaps.

12. The anti-theft display hanger of claim 1, further comprising slits formed in one or both of the flaps.

13. The anti-theft display hanger of claim 3, wherein the cable tie is custom made or is shortened after sais cable tie is secures the article to the hanger.

14. The anti-theft display hanger of claim 1, further comprising means located on the outer surfaces of one or both members to include indicia.

15. The anti-theft display hanger according to claim 14, wherein said indicia is a trademark or other branding.

16. The anti-theft display hanger of claim 1, wherein the article is selected from the group consisting of necklace, pendant, chain, bracelet and earing set.

17. The anti-theft display hanger of claim 1, further comprising an electronic article surveillance sensor.

18. The anti-theft display hanger of claim 1, wherein said hanger is comprised from plastic.

19. A method of making an anti-theft display hanger for supporting an article, comprising the steps of:

providing a first member having an outer surface, an inner surface, a top portion, a bottom portion and a thickness defined between the outer surface and inner surface;

providing a second member having an outer surface, an inner surface, a top portion, a bottom portion and a thickness defined between the outer surface and inner surface, the second member being a mirror image of the first member and being constructed and arranged to overlay at least a portion of the first member in an assembled position;

providing a gusset situated between said members wherein said gusset having one or more dielines which create two or more flaps having apertures in said flaps wherein when the hanger is assembled, a recess, in which an article for sale is positioned, is formed;

folding the two flaps formed in the gusset inward towards each other so that the apertures contained within said flaps align;

threading a cable tie through the aligned apertures of the flaps;

securing said article to the hanger using the cable tie; and folding the two members inward and towards each other until one member overlays a portion of the second member.

* * * * *